US007628431B2

(12) United States Patent
Evans et al.

(10) Patent No.: US 7,628,431 B2
(45) Date of Patent: Dec. 8, 2009

(54) DEVICE FOR SANITARY REMOVAL OF CANINE FECAL MATTER AND METHOD THEREFOR

(76) Inventors: John C. Evans, 96 Mount Vernon Cir., Atlanta, GA (US) 30338; Margaret L. Evans, 96 Mount Vernon Cir., Atlanta, GA (US) 30338

( * ) Notice: Subject to any disclaimer, the term of this patent is extended or adjusted under 35 U.S.C. 154(b) by 0 days.

(21) Appl. No.: 12/070,188

(22) Filed: Feb. 19, 2008

(65) Prior Publication Data

US 2009/0050065 A1 Feb. 26, 2009

Related U.S. Application Data

(60) Provisional application No. 60/965,316, filed on Aug. 20, 2007.

(51) Int. Cl.
*A01K 29/00* (2006.01)

(52) U.S. Cl. ..... 294/1.4; 294/1.3

(58) Field of Classification Search ..... 294/1.3–1.5
See application file for complete search history.

(56) References Cited

U.S. PATENT DOCUMENTS 4,477,111 A * 10/1984 Crooks ..... 294/1.4

FOREIGN PATENT DOCUMENTS

EP 93200392.4 8/1993

* cited by examiner

*Primary Examiner*—Paul T Chin
(74) *Attorney, Agent, or Firm*—Rodgers & Rodgers

(57) ABSTRACT

A device for removing canine fecal matter includes a lobed knob connected by concentric tubes to a dual housing, the inner of which holds a set of panels that are opened or closed by the linear movement of the smaller tube in combination with a panel actuating ring affixed to the inner shaft. The panels are extended by holding the larger tube and pushing the knob toward the panel housing. When a release button is actuated, the panels close around the fecal matter and, with the panels closed, a protective collection bag is secured by a clamp on the outer housing. With the collection bag inside the cavity formed by the closed panels. The knob can be rotated in either direction to turn the collection bag which causes the collection bag to pull away from the clamp for the purpose of disposal.

3 Claims, 5 Drawing Sheets

DEVICE FOR SANITARY REMOVAL OF CANINE FECAL MATTER AND METHOD THEREFOR

The benefits under 35 U.S.C. 119 are claimed of provisional patent application 60/965,316 filed Aug. 20, 2007.

TECHNICAL FIELD

The present invention relates to the collection and disposal of animal waste, and more particularly to an apparatus for collection and disposing of canine fecal matter without human contact.

BACKGROUND ART

Each day, in complete disregard of county health ordinances, condominium rules, or park regulations, dog owners fail to pick up fecal matter deposited by their pets. Because of the unpleasantness and potential health risk of retrieving such matter there is a natural aversion to this odious chore and as a result, there have been innumerable devices invented to help minimize this problem.

The most popular and most portable retrieval device is the simple plastic bag such as those found in most pet related stores or the plastic grocery bag, both of which require the user to stoop and physically touch the droppings while the hand is protected by the integrity of the thin plastic. The primary problem with this method is that a second bag must be used to hold the contained drooping until a proper container can be found; not to mention the development of a threshold for the task.

The scoop and handle design, such as the "S.A.S.I. Scoop" has the convenience of using plastic grocery bags, but does not work well in taller grasses or plant beds. If the waste is not firm, removing the bag can be a very messy proposition.

Those devices using separated fingers operated by a squeeze handle, including the "Poop Hound" are often difficult to use with one hand and have the disadvantage of having the moving set of fingers come in direct contact with the fecal matter.

The rake and scoop products, such as the "FlexRake Scoop", while effective and easy to use, come in direct contact with the fecal matter and require the additional step of bagging the waste before depositing it in the trash.

SUMMARY OF THE INVENTION

The present invention solves significant problems in the art by providing a canine fecal matter collection device where neither the operator nor the device is in direct contact with the animal waste.

Generally described, the present invention provides a means for holding a simple plastic bag over a plurality of fingers or panels that fully encompass the waste material during the retrieval process in a manner similar to that of the human hand.

The collection mechanism includes a lobed knob connected by a combination of concentric tubes of a specified length to a dual housing arrangement, the inner housing of which holds a set of panels that can be opened or closed by the linear movement of the smaller of the two tubes in combination with a panel actuating ring affixed to this inner shaft. The operation of the panels can best be described as that of a collapsible vegetable steamer.

The unit is spring loaded and is latched in the operating position—panels extended—by holding the larger tube and pushing the knob linearly toward the panel housing. This feature allows the unit to be operated by one hand when collecting the waste material.

When a release button, located in the side of the knob, is actuated, the complimenting panels close around the fecal matter in such a manner that no material is extruded between the individual panels.

With the panels closed, and the protective collection bag secured by a simple clamp on the side of outer housing, the knob can be rotated in either direction. This action causes the waste filled collection bag inside the cavity formed by the closed panels to turn while the portion of the bag outside of the panels remains fixed to the outer housing until the wrapping action pulls the bag from the clamp.

The fecal material, secured in the disposable collection bag, can then be disposed of, when desired, by simply cocking the apparatus as described above and releasing it into an appropriate waste container.

Other objects, features, and advantages of the present invention will become apparent upon reading the following detailed description of embodiments of the invention when taken in conjunction with the accompanying drawings and the appended claims.

DETAILED DESCRIPTION

Figure 1:
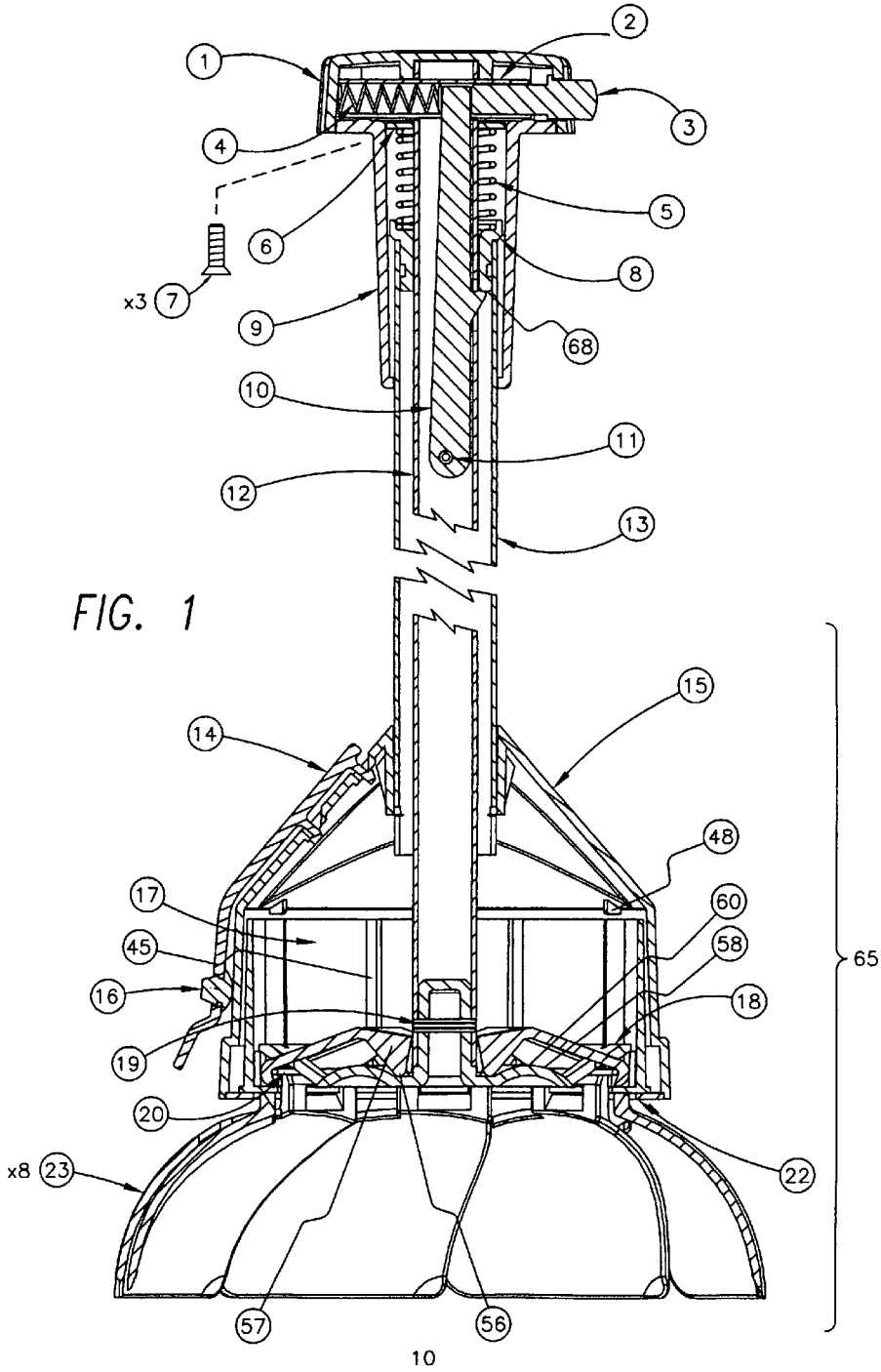
FIG. 1. is a sectioned view of the apparatus showing individual part location.

Referring to the drawing, in which like numerals refer to like parts throughout the several views, FIGS. 1 and 2A-2C show a housing 15 into which a cylindrical outer tube 13 of a specified length having preformed end tabs 24 which are inserted into corresponding openings 25 in the housing 15 top for the purpose of securing the housing 15 to the outer tube 13 by twisting the tabs 24. A spring cover 9 is installed over the outer tube 13 prior to installing the locating bushing 8 in the open end 26 of the outer tube 13.

A cylindrical inner tube 12 of a specified length having two small through holes 27 and 28 for the insertion of retaining pins 11 and 19, a larger through hole 29 at 90 degrees to holes 27 and 28, and a rectangular hole 30 at 90 degrees to holes 27 & 28, is installed over a centrally located protrusion 31 of the actuating ring 18 and is affixed to the ring 18 by aligning tube hole 27 and the corresponding hole 32 in the actuating ring 18 and installing a spring pin 19.

A latch 10 is installed in the open end 33 of the inner tube 12 and positioned so that a small tab 35 located on an edge of the latch 10 is aligned with the rectangular opening 30 in the wall of the inner tube 12. A cylindrical pin 11 is directed through the first side of the tube hole 28 and through the hole 36 located at the base of the latch 10; the pin 11 is then extended through the tube 12. Those skilled in the art will recognize that the pin 11 now becomes a pivot point for the latch 10 and that the edge tab 35, when properly positioned, may extend through the rectangular opening 30.

Figure 2A:
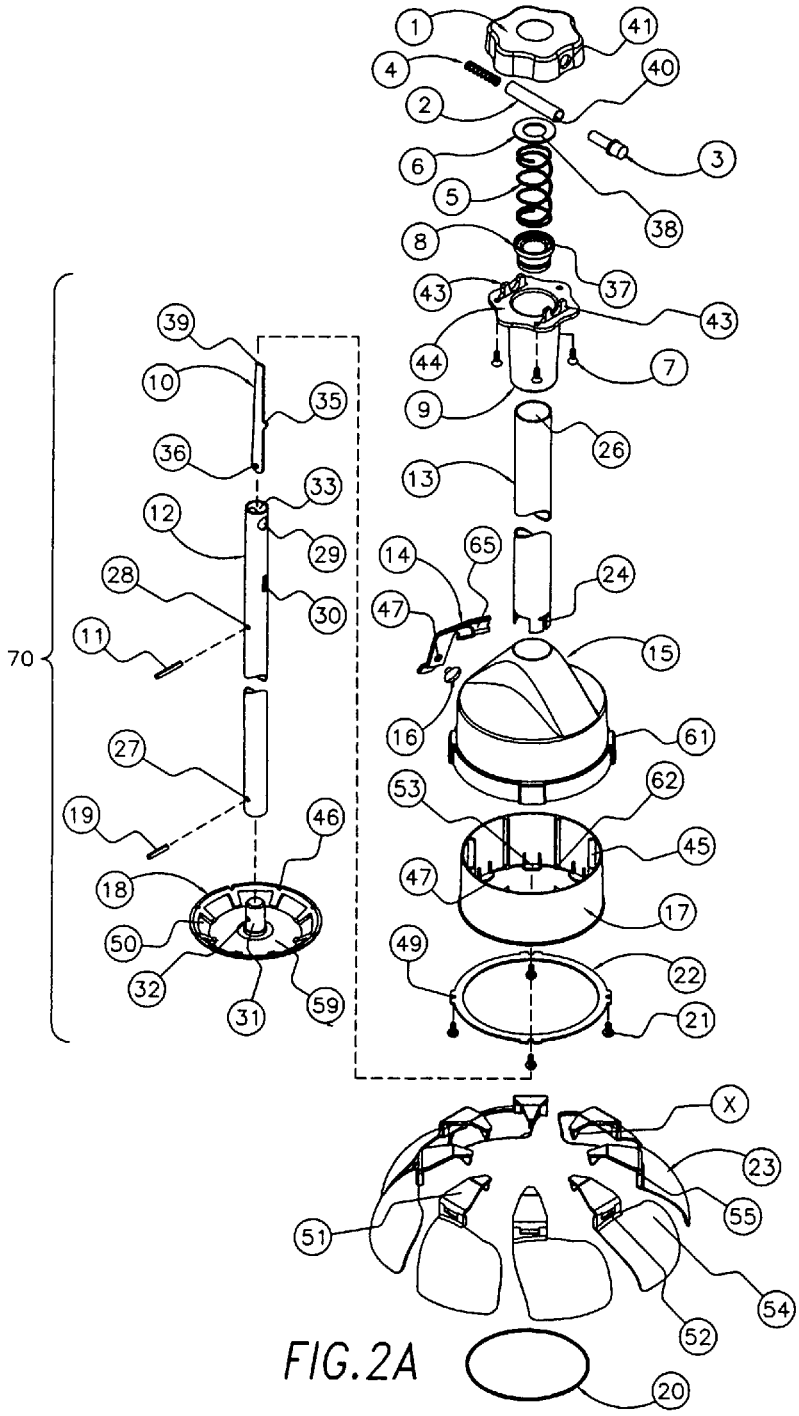
FIG. 2A. is an exploded view of the elements of the apparatus shown in FIG. 1.

Referring FIGS. 1 and 2A., the inner tube assembly 70 shown in FIG. 2A, can now be inserted vertically through the housing 15, through the outer tube 13, and guided through the locating bushing 8.

A compression spring 5 is installed over the open end 33 of the inner tube 12, part of the inner tube assembly 70, and is seated in a shallow recess 37 in top of the locating bushing 8. A simple flat washer 6 having a center hole 38 of sufficient size to fit over the inner tube 12 is placed on the top of compression spring 5. Compressing the compression spring 5 and guiding the washer 6 over the open end 33 of the tube 12 exposes the through hole 29 in the top end of the inner tube 12 and a portion of the top end 39 of the latch 10.

A short cylindrical tube 2 having a narrow slot 40 the full length of the part is orientated such that the slot 40 is in a position that when the tube 2 is inserted into the hole 29, the tip 39 of the latch 10 will pass through the slot 40. Extending the tube 2 fully through the hole 29 secures the compression spring 5 and the washer 6.

As depicted in FIG. 2A., a small compression spring 4, of sufficient length, when inserted into the left end of the short tube 2 and confined by the lobed knob 1 will act to rotate the latch 10 about the pivot pin 11 causing the edge tab 35 of the latch 10 protrude through the rectangular opening 30 in the side of the inner tube 12. Inversely, a cylindrical button 3 of proper length, when inserted in the right end of the tube 2, and extended through a hole 41 in the side of the lobed knob 1 will, with sufficient force, rotate the latch 10 in the opposite direction and cause the edge tab 35 to move away from the rectangular opening 30 in the side of the inner tube 12.

Figure 2C:
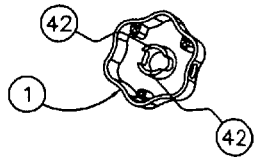
FIG. 2C. is a bottom view of knob shown in FIG. 2A.
Figure 2B:
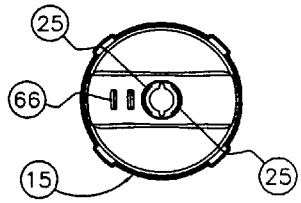
FIG. 2B. is a top view of the outer housing shown in FIG. 2A.

Referring to FIG. 2C., two protrusions 42 extending from the inside of the lobed knob 1 and two similar saddle like forms 43 extending from the flanged portion 44 of the spring cover 9 provide a means of securing the cylindrical tube 2 to the lobed knob 1 when the spring cover 9 and the lobed knob 1 are joined by fasteners 7.

Figure 3A:
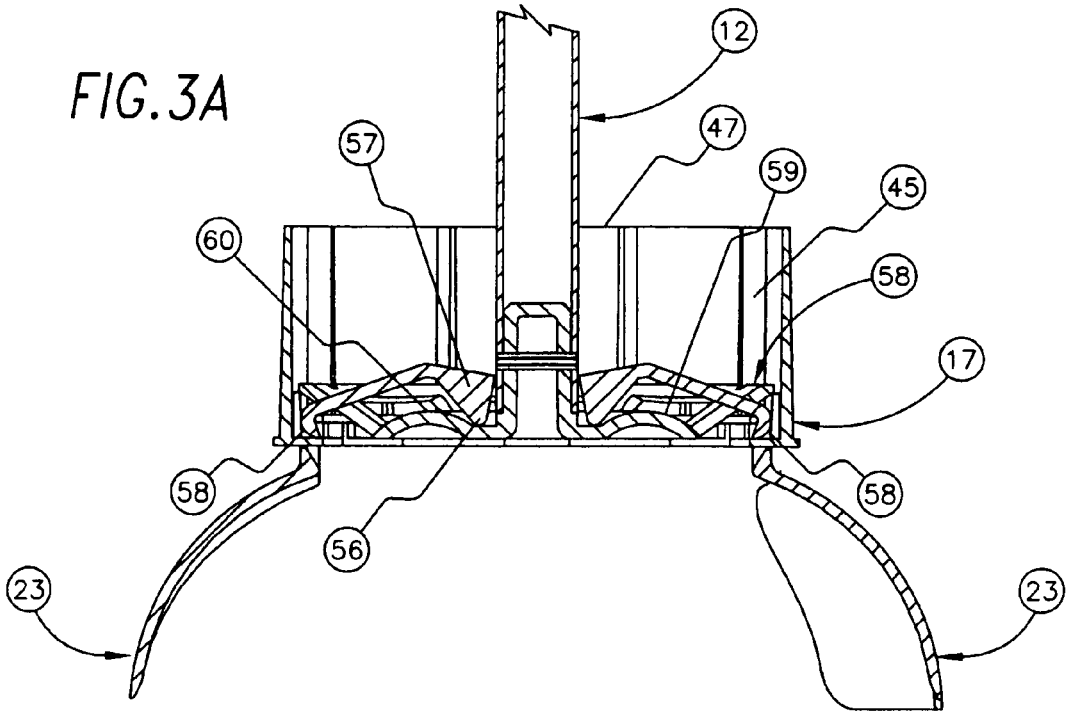
FIG. 3A. is a sectioned view showing a portion of the apparatus with the panels in the open, or extended position.

Referring to FIGS. 1, 2A and 3A & B, the equally spaced alignment ribs 45 extending inward and vertically from the cylindrical inside wall of the panel mounting housing 17 when aligned with the identically positioned "v" grooves 46 located on the perimeter of the actuating ring 18, part of assembly 70, allows the panel mounting housing 17 to be inserted into the open bottom of the outer housing 15. The panel mounting housing 17 is captured by equally spaced tabs 48 which are part of the housing 15 and by a circular retaining plate 22 that is connected to a multiple of bosses 61 at the bottom of the housing 15 by a like number of threaded fasteners 21 installed through equally spaced slots 49 in the perimeter of the retaining plate 22.

Figure 3B:
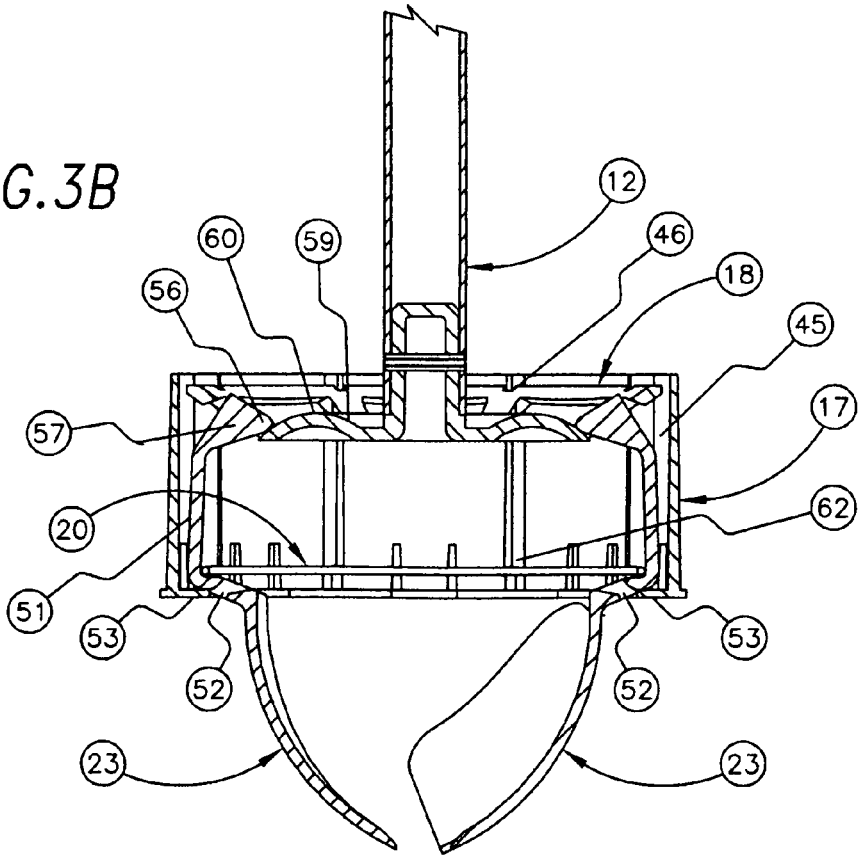
FIG. 3B. is a sectioned view showing a portion of the apparatus with the panels in the closed position.

Referring to FIGS. 3A and 3B, those skilled in the art will recognize the advantage of having the alignment ribs 45 of the panel mounting housing 17 pass through the "v" grooves 46 in the actuating ring 18. More specifically, any rotational movement of the actuating ring 15, is coupled directly to the panel mounting housing 17 and therefore any part attached to the housing 17. This coupling feature is effective whether the driving force of the actuating ring 18 is at the bottom of the alignment ribs 45, FIG. 3A., or at the top of each rib 45, FIG. 3B.

FIG. 2A, shows a multiple of rectangular openings 50 in the perimeter of the actuating ring 18 through which the triangular lever arm 51 of a panel 23 is inserted before positioning the opening 52 in the panel 23 over a panel mounting tab 53 which projects inwardly from the inner wall of the panel mounting housing 17. Each successive panel 23 is installed in a clockwise direction (as viewed from the bottom) to insure that the extended side 54 of each panel 23 overlaps the previously installed panel 23. Upon the installation of all panels 23 a retaining ring 20 is inserted into a lateral groove 55 located at the inside base of the panel 23 lever arm 51.

Referring to FIG. 3B, inward movement of each panel 23 is prevented by retaining ring 20, upward movement of the retaining ring 20 and thus each panel 23 is prevented by the overlapping of the retaining ring 20 by an extension 62 of each alignment rib 45. All downward movement of the panels is prevented by the panel mounting tabs 53 of the panel mounting housing 17.

Referring to FIGS. 3A and 3B., it can be demonstrated that the tip 56 of the triangular protrusion 57 located on the lower side of the panel lever arm 51 and touching the upper curved surface 59 of the actuating ring 18, will, with any vertical movement of the actuating ring 18, cause the panel 23 to rotate on the radial surface 58, which is a feature of the opening 52 of each panel 23. It can also be shown that the rate of rotation of the panel 23 is increased due the movement of tip 56 as it moves upward over the curved surface 59 of the actuating ring 18. This increased rate diminishes as the tip 56 reaches the apex 60 of the curved surface 59. This feature allows the panel 23 to rotate further when the compressed spring 5 is at is maximum potential. Additional vertical movement of the actuating ring 18 causes the tip 56 to descend from the apex 60 and this ramp action of the tip 56 on the curved surface 59 increases the mechanical advantage of the lever arm 51 when the compression spring 5 is at a lower potential.

FIG. 1 shows the compression spring 5 locked in a compressed position which causes actuating ring 18 to move to its lowest position and the panels 23 to open as depicted due to the force exerted on the lever arm 51 by the perimeter of the actuating ring 18. This locked position is attained by holding the large outer tube 13 and pressing the lobed knob 1 linearly toward the housing 15 (arrow 67 FIG. 4D). As the knob 1 is pushed, the angled portion of the latch tab 35, a feature of the latch 10, is eventually forced against the inside surface of guide bushing 8 which causes the latch 10 to rotate about pin 11 and the latch tab 35 to move inside the rectangular opening 30 located in the side of the inner tube 12. This action likewise compresses the button return spring 4. When the latch tab 35 clears the bottom 68 of the guide bushing 8, it immediately returns to its initial position due to the action of spring 4, and the now extended tab 35 is fixed against the bottom edge 68 of the guide bushing 8, thus holding the mechanism in this position until the release button 3 is pressed and the action is reversed.

Referring to FIGS. 4A-4D, a geometrically shaped collection bag 64, constructed of a thin, typically plastic, material and having a single opening 66, is placed over the housing assembly 65, and under the retention clamp 14 to which is affixed, through a hole 47 at the free end of the clamp 14, a friction bumper 16 which is constructed of a material that when deformed has the ability to recover.

Figures 4A, 4B, 4C, 4D:
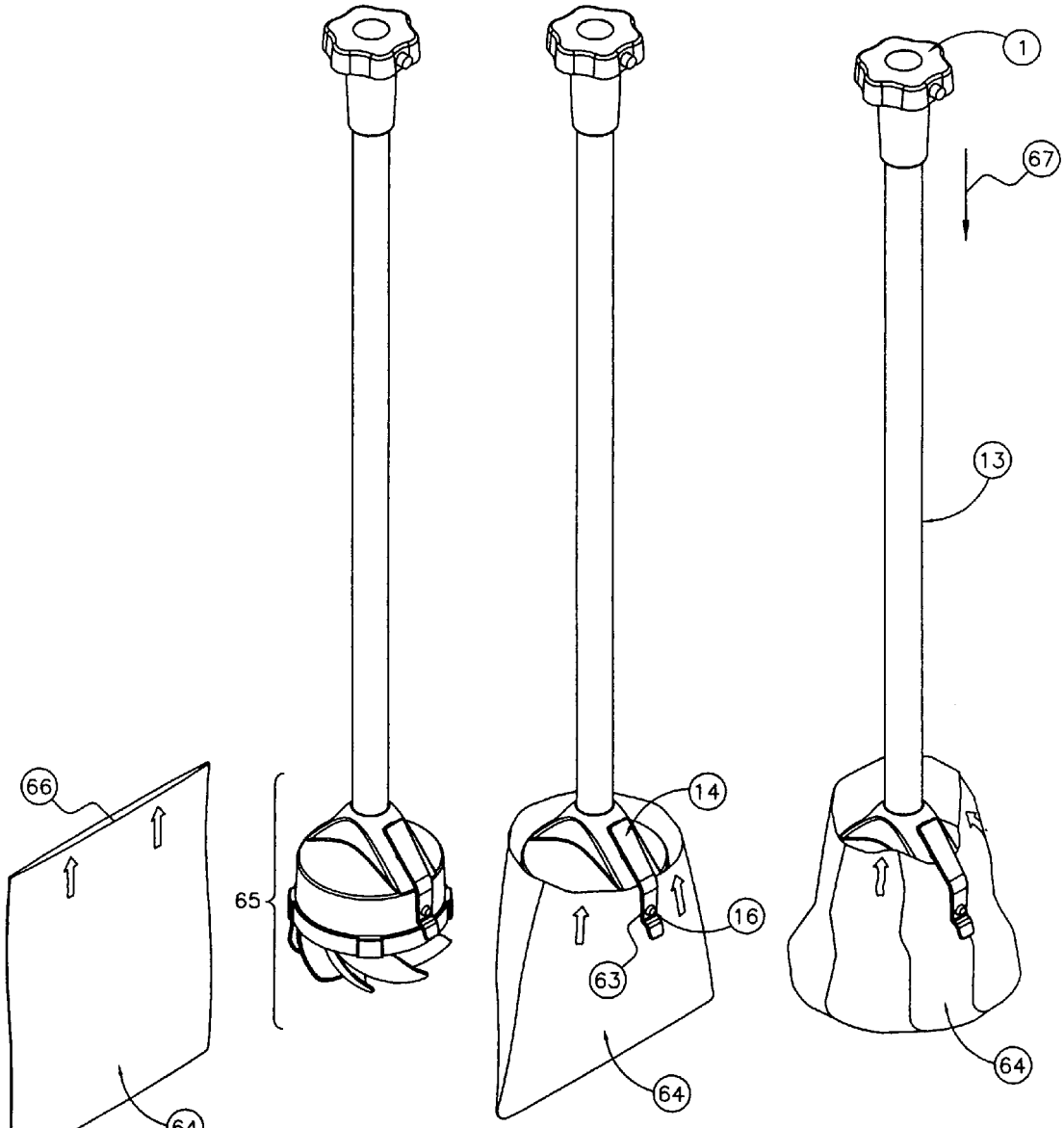
FIG. 4A. is a pictorial view of the protective collection bag.
FIG. 4B. is an isometric view of the apparatus in the closed position.
FIG. 4C. is a depiction of the apparatus with the collection bag positioned over the closed panels and under the retention clamp.
FIG. 4D. is a diagrammatic view of the installed collection bag with the apparatus panels extended.

FIG. 4D, shows the apparatus and collection bag 64 with the panels in the extended position in preparation of the collection of waste material. This action is accomplished by holding the outer shaft 13 and pushing the knob 1 approximately 1¼ inches in the direction of the arrow 67.

Referring to FIGS. 5A-5D, FIG. 5A depicts the apparatus in the panel closed position after the release button 3 has been depressed, and the knob 1 turned in the direction of the arrow 68 until such time the collection bag 64 is about to pull free of the retention clamp 14.

Figures 5A, 5B, 5C, 5D:
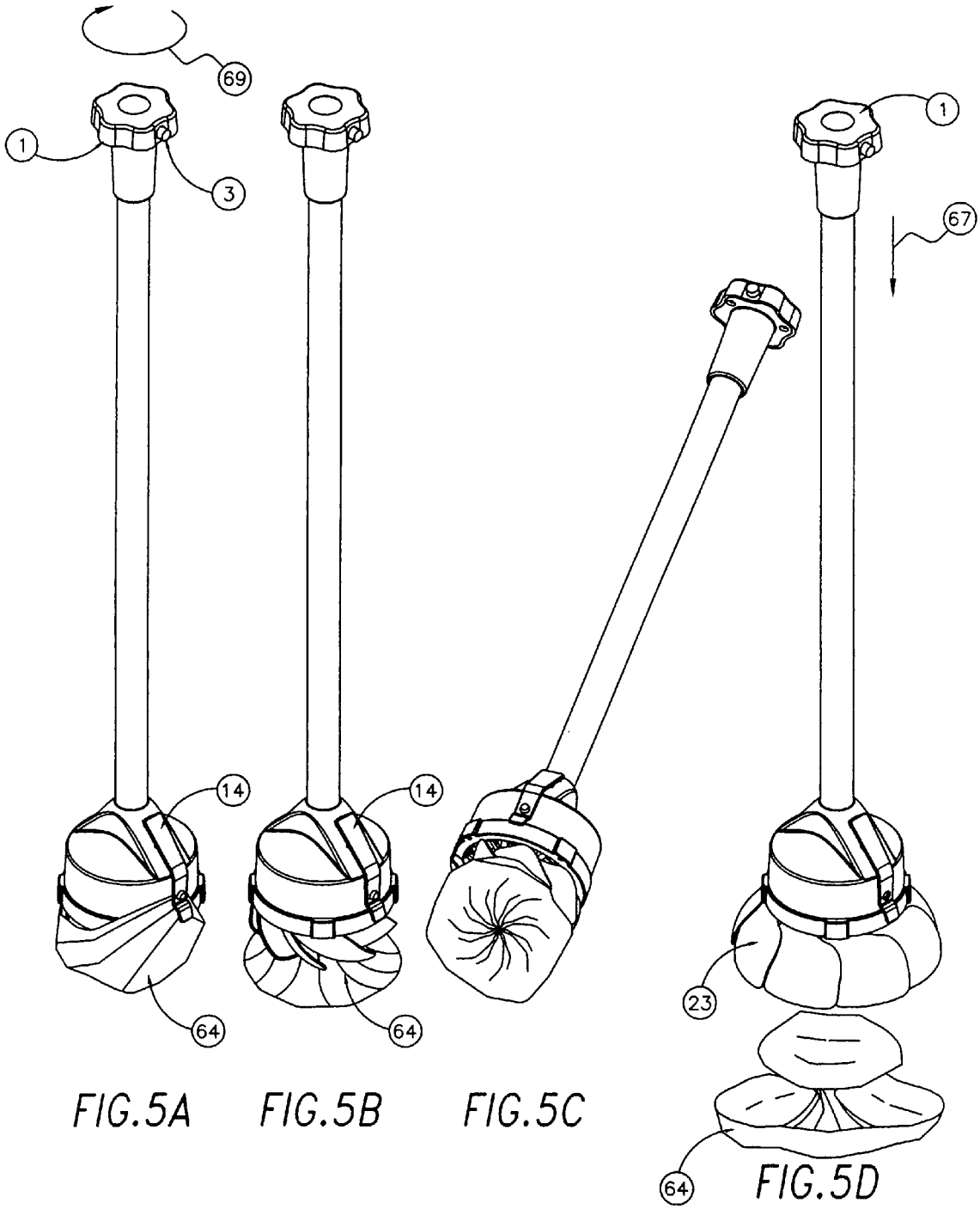
FIG. 5A. is a diagrammatic view depiction a post collection view of the apparatus and the result of rotating the lobed knob after waste collection with a portion of the collection bag still under the retention clip.
FIG. 5B. is a diagrammatic view depicting the collection bag free of the retention clip as a result of continued knob rotation.
FIG. 5C. is a bottom view of FIG. 5B.
FIG. 5D. is a diagrammatic view of the waste collection bag as it is ejected from the apparatus.

FIGS. 5B and 5C, depict the apparatus with the collection bag free of the retention clamp 14.

FIG. 5D, depicts the ejection of the waste filled collection bag 64 as a result of a partial or full extension of the collection panels 23.

While the present invention has been illustrated by description of several embodiments and while the illustrative embodiments have been described in detail, it is not the intention of the applicant to restrict or in any way limit the scope of the appended claims to such detail. Additional modifications will readily appear to those of ordinary skill in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. A method for disposing of canine fecal matter utilizing a device having a pair of telescopic handles with a release button and a knob positioned at one end of said handles, a housing fixed to the other end of said handles, multiple overlapping panels having extended fingers disposed below said housing and rotatable about the axis of said handles, and a retention clamp secured to said housing, said method comprising the steps of:

installing a geometrically shaped bag of thin material having a free edge over the closed panels of the device and positioning said free edge under said retention clamp;

opening and latching in an extended position said bag enclosed panels such as to create a cavity for the collection of canine waste matter;

positioning the device over the canine waste matter in preparation for collection;

pressing said release button positioned in the side said knob causing the closing of said extended panels around the waste matter;

rotating said knob such as to cause said bag and the collected matter encompassed by the closed panels to turn so that portion of the bag outside of the closed panels and held by the retention clamp wraps about itself until such time that said free edge is pulled away from said retention clamp; and opening or partially opening said extended fingers of said panels to deposit the bagged waste material into a suitable waste container.

2. A method according to claim 1 wherein a friction bumper is affixed to the free end of said retention clamp.

3. A method according to claim 1 where said opening and latching is accomplished by pushing said knob toward said bag.

* * * * *